US011529595B2

(12) United States Patent
Tamminga et al.

(10) Patent No.: US 11,529,595 B2
(45) Date of Patent: Dec. 20, 2022

(54) INCLINABLE MIXER

(71) Applicant: Jay-Lor International Inc., East Garafraxa (CA)

(72) Inventors: Jakob Tamminga, East Garafraxa (CA); Gerry Tamminga, Fergus (CA); Chris Bessey, Fergus (CA)

(73) Assignee: JAY-LOR INTERNATIONAL INC., Ontario (CA)

( * ) Notice: Subject to any disclaimer, the term of this patent is extended or adjusted under 35 U.S.C. 154(b) by 13 days.

(21) Appl. No.: 16/610,194

(22) PCT Filed: Apr. 30, 2018

(86) PCT No.: PCT/CA2018/050501

§ 371 (c)(1),
(2) Date: Nov. 1, 2019

(87) PCT Pub. No.: WO2018/201235

PCT Pub. Date: Nov. 8, 2018

(65) Prior Publication Data

US 2020/0384430 A1 Dec. 10, 2020

Related U.S. Application Data

(60) Provisional application No. 62/501,555, filed on May 4, 2017.

(51) Int. Cl.
*B22C 5/00* (2006.01)
*B01F 27/1145* (2022.01)
(Continued)

(52) U.S. Cl.
CPC ..... *B01F 27/1145* (2022.01); *B01F 27/61* (2022.01); *B01F 27/724* (2022.01); *B01F 2101/18* (2022.01)

(58) Field of Classification Search
CPC ..... B01F 7/00433; B01F 7/021; B01F 7/027; B01F 7/082; B01F 7/086; B01F 2215/0008; B01F 27/627; B01F 27/1145
See application file for complete search history.

(56) References Cited

U.S. PATENT DOCUMENTS 2,894,733 A * 7/1959 Wosmek ..... B01F 13/0035 366/183.2
4,219,239 A * 8/1980 Weikert ..... E21C 25/10 299/81.1
(Continued)

FOREIGN PATENT DOCUMENTS

DE 3419997 A1 * 8/1985 ..... B01F 7/02
EP 1302420 A2 * 4/2003 ..... B65G 47/19
(Continued)

OTHER PUBLICATIONS

Machine translation of DE3419997A1 is attached (Year: 1985).*
(Continued)

*Primary Examiner* — Anshu Bhatia
*Assistant Examiner* — Gregory Y Huan
(74) *Attorney, Agent, or Firm* — Foley & Lardner LLP

(57) ABSTRACT

An inclinable mixer for mixing bulk material is provided herein. The inclined mixer comprises a mixing chamber which comprises a longitudinal trough defined by a first and second side wall oppositely opposed, the trough having a front end opposite a back end, a discharge opening positional substantially in the bottom of the chamber toward the back end, and a front wall spanning the front end of the trough. The mixer also comprises an auger situated longitudinally in the trough for mixing bulk material, and a driving device for rotating the auger when a driving force is
(Continued)

applied, wherein the mixing chamber is inclined at least during mixing such that the back end is raised relative the front end.

20 Claims, 9 Drawing Sheets

(51) Int. Cl.
*B01F 27/61* (2022.01)
*B01F 27/724* (2022.01)
*B01F 101/18* (2022.01)

(56) References Cited

U.S. PATENT DOCUMENTS 4,310,252 A 1/1982 Ryan
4,441,820 A * 4/1984 Maxon, III ..... B28C 5/141 366/185
4,797,004 A 1/1989 Buschbom
5,228,775 A * 7/1993 Horn ..... B01F 7/08 366/278
5,249,860 A 10/1993 Buschbom et al.
5,299,865 A * 4/1994 Presnell ..... B01F 27/721 366/300
5,439,182 A * 8/1995 Sgariboldi ..... A01F 29/005 241/260.1
2002/0122350 A1 9/2002 White et al.
2007/0197852 A1* 8/2007 Wilson ..... A61L 2/0023 422/198
2008/0078853 A1* 4/2008 Sugino ..... B01F 15/00785 241/260
2009/0238031 A1* 9/2009 Conard ..... B01F 15/0479 366/162.2
2014/0367219 A1* 12/2014 Houssian ..... A01D 87/00 198/312

FOREIGN PATENT DOCUMENTS

JP 2006123285 A * 5/2006 ..... B01F 27/724
WO WO-96/15889 A2 6/1996

OTHER PUBLICATIONS

Google machine translation for "JP-2006123285-A" (Year: 2006).*
Google machine translation for "EP-1302420-A2" (Year: 2003).*
International Search Report issued in International Application No. PCT/CA2018/050501 dated Jul. 17, 2018, three (3) pages total.
Written Opinion issued in International Application No. PCT/CA2018/050501 dated Jul. 17, 2018, five (5) pages total.

* cited by examiner

INCLINABLE MIXER

TECHNICAL FIELD

The invention relates to mixers and more specifically to inclinable mixers for mixing bulk material.

BACKGROUND

In the agricultural industry, mixers are often used for mixing bulk materials such as for example feed for animals and compost. Mixing such materials allows for better distribution of the material and results in less variance.

Ideally, mixing of the bulk material imparts minimal compaction of the material and decreased variance among the mixed bulk material.

Current mixing devices impart compaction to the bulk material that can be overly dense or does not allow ideal air within the mixed bulk material. Further, various current mixing devices require overly long mix times and/or high amounts of power consumption to achieve a desired level of variance.

A need therefore exists for a mixing device that allows for a higher quality mix that requires less power consumption and/or less mixing time and that may also achieve a more desirable level of variance and/or a more desired level of compaction in the mixed bulk material.

SUMMARY

An inclinable mixer is provided for mixing bulk material in an inclined position. The inclined position of the mixer allows for material being mixed to be carried upwards along the auger and tumble backwards towards a lowered front of the mixer for further mixing. A ribbon auger may be used to allow for further tumbling and mixing between the ribbon and the auger post. The inclined nature of various embodiments of the mixers described herein provides high quality variance, meaning little to no variance, in the mix following mixing as well as less compacting of the mix. In certain embodiments, a reduction in power consumption was observed. This is likely as a result of the reduction in compacting of the mix and a decrease in the density of the mix as the mix appear to be more airy following mixing.

In one embodiment, the present invention provides for an inclinable mixer for mixing bulk material, the inclined mixer comprising:

- a mixing chamber comprising:
  - a longitudinal trough defined by a first and second side wall oppositely opposed, the trough having a front end opposite a back end,
  - a discharge opening positional substantially toward the back end of the mixing chamber, and
  - a front wall spanning the front end of the trough,
- an auger situated longitudinally in the trough for mixing bulk material, and
- a driving device for rotating the auger when a driving force is applied,
- wherein the mixing chamber is inclined at least during mixing such that the back end is raised relative the front end.

In a further embodiment of the inclinable mixer as outlined above, the inclinable mixer further comprises:

- front legs for supporting the front end of the mixing chamber, and
- back legs for supporting the back end of the mixing chamber.

In a further embodiment of the inclinable mixer as outlined above, the back legs are positioned inward from the back end such that the discharge opening is closer to the back end than the back legs allowing the discharge opening to output material mixed therein without interference from the back legs.

In a further embodiment of the inclinable mixer as outlined above, the front legs and/or the back legs are adapted to raise and lower the front end and/or back end of the mixer to change the degree of incline of the mixer.

In a further embodiment of the inclinable mixer as outlined above, the front legs are adapted to raise and lower the front end of the mixer to move the mixer from an inclined position, for mixing bulk material to a substantially level position for unloading of the mixer chamber.

In a further embodiment of the inclinable mixer as outlined above, the front legs are telescoping legs.

In a further embodiment of the inclinable mixer as outlined above, the front legs are scissor legs, optionally hydraulically operated.

In a further embodiment of the inclinable mixer as outlined above, the front and back legs are operable to lift the mixer into an unloading position at a height sufficient to allow a delivery vehicle to pass beneath the discharge opening.

In a further embodiment of the inclinable mixer as outlined above, the inclinable mixer further comprises:

- a front baffle positioned at the front end of the mixing chamber and transverse and above the auger for guiding bulk material towards the auger.

In a further embodiment of the inclinable mixer as outlined above, the inclinable mixer further comprises:

- a front right baffle positioned at the front end of the mixing chamber between the auger and the second side wall for guiding bulk material towards the auger.

In a further embodiment of the inclinable mixer as outlined above, the inclinable mixer further comprises:

- a front left baffle positioned at the front end of the mixer chamber between the auger and the first side wall for guiding bulk material towards the auger.

In a further embodiment of the inclinable mixer as outlined above, the trough is a V-shaped trough, a U-shaped trough or a tube.

In a further embodiment of the inclinable mixer as outlined above, the first and second side walls of the trough are substantially symmetrical.

In a further embodiment of the inclinable mixer as outlined above, the first and second side walls of the trough are substantially asymmetrical with one of the two side walls situated at a steeper angle relative the other side wall.

In a further embodiment of the inclinable mixer as outlined above, the mixing chamber is for inclination to above 20 degrees during mixing.

In a further embodiment of the inclinable mixer as outlined above, the mixing chamber is for inclination to above 40 degrees during mixing.

In a further embodiment of the inclinable mixer as outlined above, the mixing chamber is for inclination to or above 45 degrees during mixing.

In a further embodiment of the inclinable mixer as outlined above, the mixing chamber further comprises:

- a second longitudinal trough defined by a third and fourth side wall oppositely opposed, the second trough having a front end opposite a back end,
- a discharge opening positioned substantially toward the back end of the second trough, and
- a front wall spanning the front end of the second trough, the mixer further comprising a second auger situated longitudinally in the second trough for mixing bulk material.

In a further embodiment of the inclinable mixer as outlined above, the first and second augers are adapted to rotate in opposite directions during mixing.

In a further embodiment of the inclinable mixer as outlined above, the second and third walls are connected directly or indirectly at their top edges and are sufficiently short to allow for bulk material mixing in the chamber to pass over their top edges.

In a further embodiment of the inclinable mixer as outlined above, the driving device is hydraulically powered.

In a further embodiment of the inclinable mixer as outlined above, the front legs are hydraulically powered and the front legs and driving device are operated by the same hydraulic system and optionally by the same hydraulic drive source.

In a further embodiment of the inclinable mixer as outlined above, the discharge opening is positioned in substantially the bottom of the trough toward the back end of the mixing chamber.

In a further embodiment of the inclinable mixer as outlined above, the discharge opening is positioned in the side of the trough toward the back end of the mixing chamber.

In a further embodiment of the inclinable mixer as outlined above, the mixer further comprises a trough door situated over the discharge opening and movable between a closed position wherein the trough door covers the discharge opening and an opened positioned wherein the trough door uncovered the discharge opening and allows output of material from the chamber.

In a further embodiment of the inclinable mixer as outlined above, the inclinable mixer further comprises one of more additional augers, each associated with one more additional troughs.

In a further embodiment of the inclinable mixer as outlined above, a front section of the auger has a higher density of flights than a back section of the auger.

In a further embodiment of the inclinable mixer as outlined above, the auger is a multiple ribbon auger.

In a further embodiment of the inclinable mixer as outlined above, the auger is a ribbon auger.

In a further embodiment of the inclinable mixer as outlined above, a front face of the ribbon auger is covered with a plastic/polymer moulding or a stainless steel or wear surface.

In a further embodiment of the inclinable mixer as outlined above, the mixer is a batch mixer.

DETAILED DESCRIPTION

Figure 1:
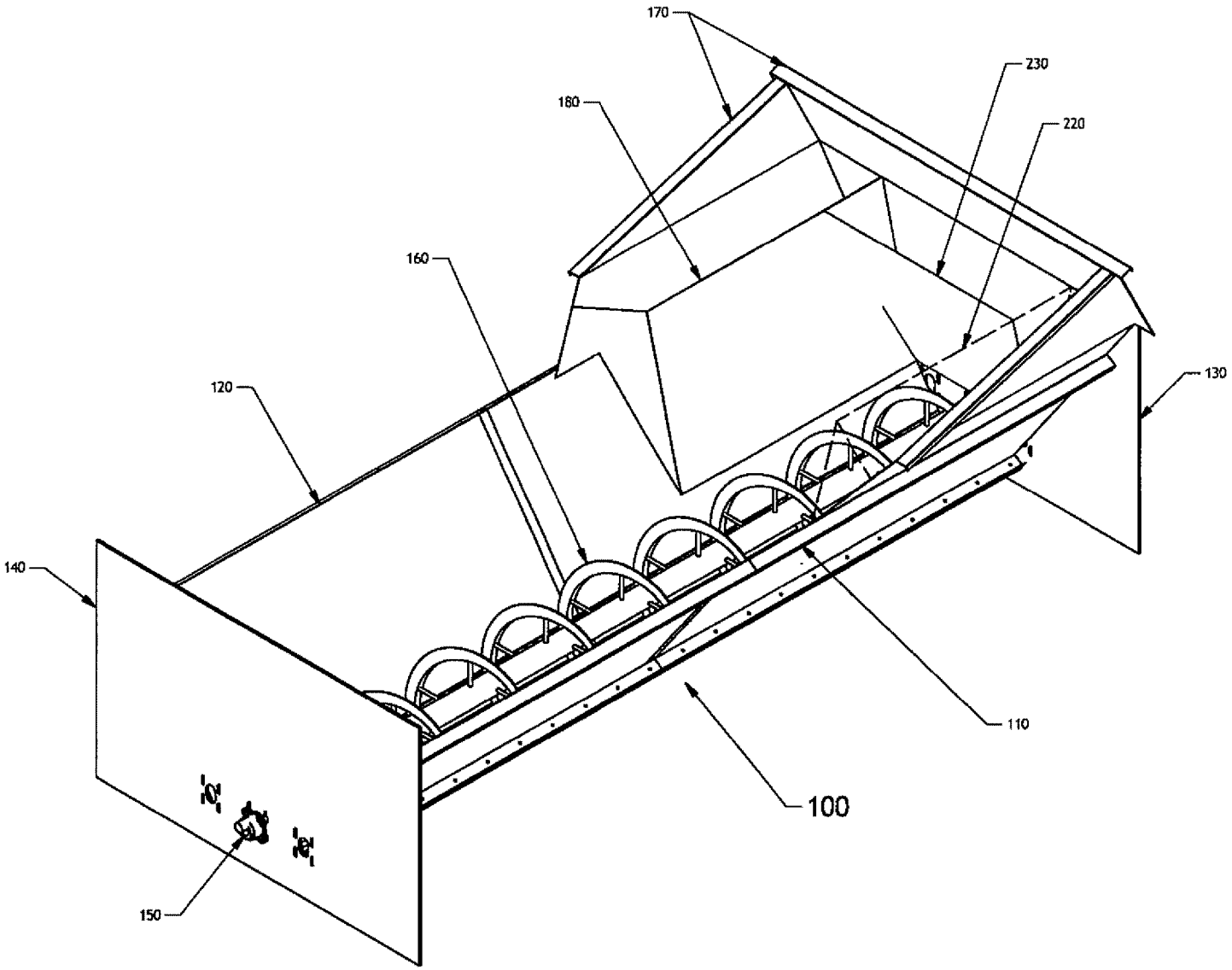
FIG. 1 is a schematic showing an isometric view of one embodiment of an inclinable mixer for mixing bulk material.
Figure 2:
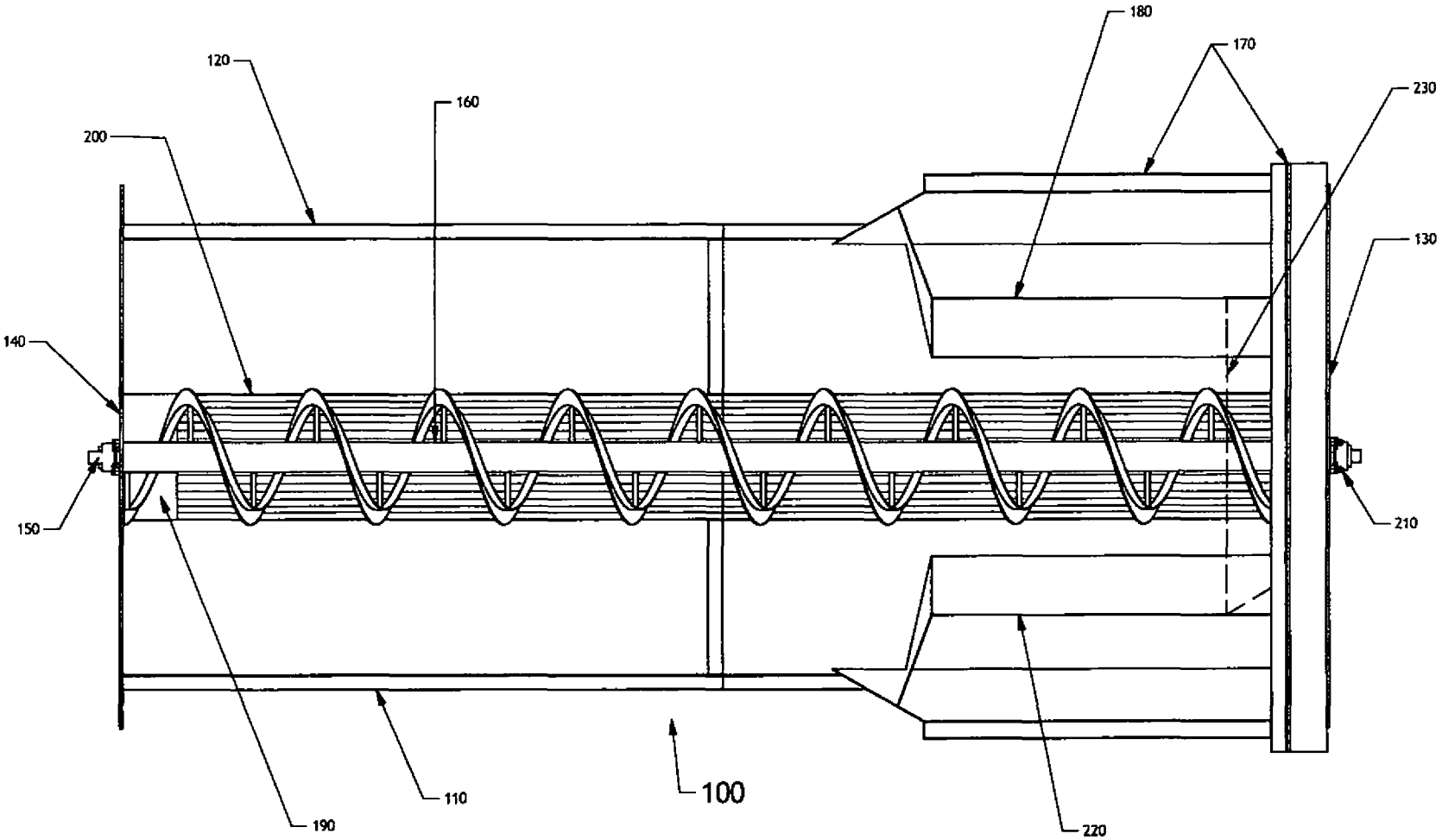
FIG. 2 is a schematic showing a top view of one embodiment of an inclinable mixer for mixing bulk material.
Figure 3:
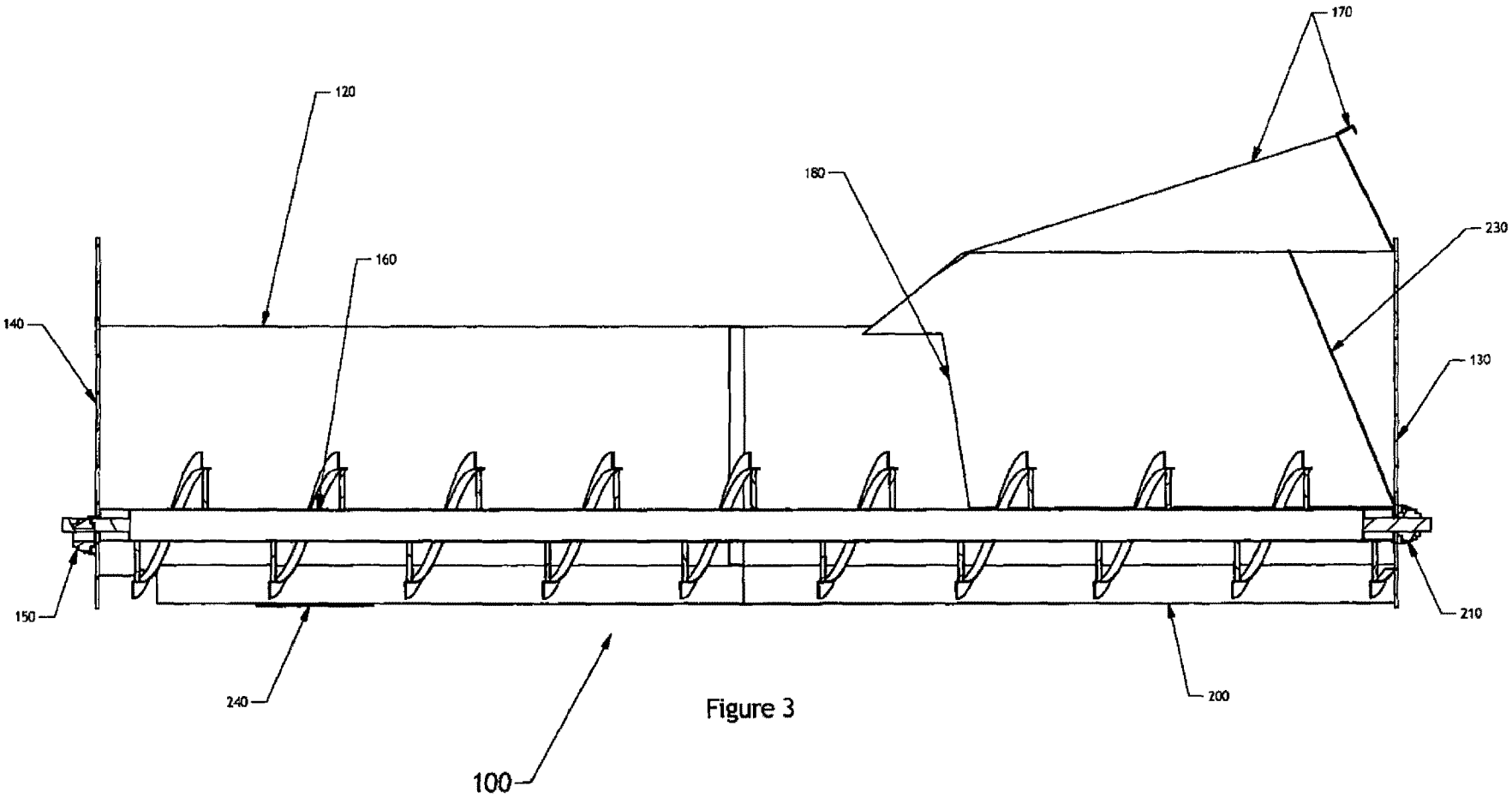
FIG. 3 is a schematic showing a side view of one embodiment of an inclinable mixer for mixing bulk material.

Described herein are methods, systems, apparatuses, techniques and embodiments suitable for mixing bulk material. It will be appreciated that the methods, systems, apparatuses, techniques and embodiments described herein are for illustrative purposes intended for those skilled in the art and are not meant to be limiting in any way. All reference to dimensions, capacities, embodiments, variants or examples throughout this disclosure, including the Figures, should be considered a reference to an illustrative and non-limiting dimension, capacity, embodiment or variant or an illustrative and non-limiting example.

FIGS. 1 to 4 show an embodiment of an open topped mixer that may be inclined for mixing bulk material. The mixer is shown in general at 100 and includes a mixing chamber generally defined by a longitudinal trough having opposing side walls 110 and 120 which define the trough. An auger 160 is situated longitudinally within the trough for mixing bulk material placed in the trough. The side walls 110 and 120 are connected at their bottom ends by a trough bottom 200 which may be rounded to substantially match the curve of the auger 160 or may be simply be defined by the meeting point of the two abutting side walls 110 and 120.

Further defining the mixing chamber are the ends of the trough which are closed off by a front wall plate 130 and a rear wall plate 140.

It will be appreciated that the mixing chamber may be in the form of a tube rather than a trough. The tube may then comprise a loading inlet and an unloading outlet. The diameter of the tube would be larger than the auger to accommodate the auger with sufficient space between the outside of the auger and the interior walls of the tube to allow for bulk material to be mixed and pass along the tube.

As will be appreciated, front and rear auger shaft bearings 210 and 150 situated in the front and rear wall plates 130 and 140, respectively, allow rotation of the auger 160. Other suitable components may be used to permit rotation of the auger as would be appreciated in the art.

Optionally, the mixer 100 may further include vault extensions 170 around portions or all of the front end of the mixer 100 to further extend the walls of the vault to capture bulk material that may have otherwise fallen out of the mixer during loading or mixing of bulk material. The vault extensions may be separate components or may be incorporated directly into the walls of the vault during or post manufacture.

A discharge opening 190 is shown as being situated in the trough bottom 200 towards the back end of the trough which is intended to be elevated relative the front end during mixing. Depending on the amount of bulk material to be mixed and the degree of inclination, the discharge opening may be left open during mixing and unloading of the mixer without significant loss of the bulk material. Optionally, a trough door 240 may be used to cover the discharge opening 190 during mixing or otherwise to prevent output of bulk material through the discharge opening 190 and may operate between an open and closed position to allow output of mixed bulk material when desired, for example, when the mixer is in a level position or an otherwise suitable position for unloading of material from the trough. Examples of mixing and unloading positions of the mixer will be discussed in further detail with reference to FIGS. 5 and 6.

The discharge opening may be situated at any suitable location for allowing output of the mixed bulk material including in a side of the mixing chamber.

Figure 4:
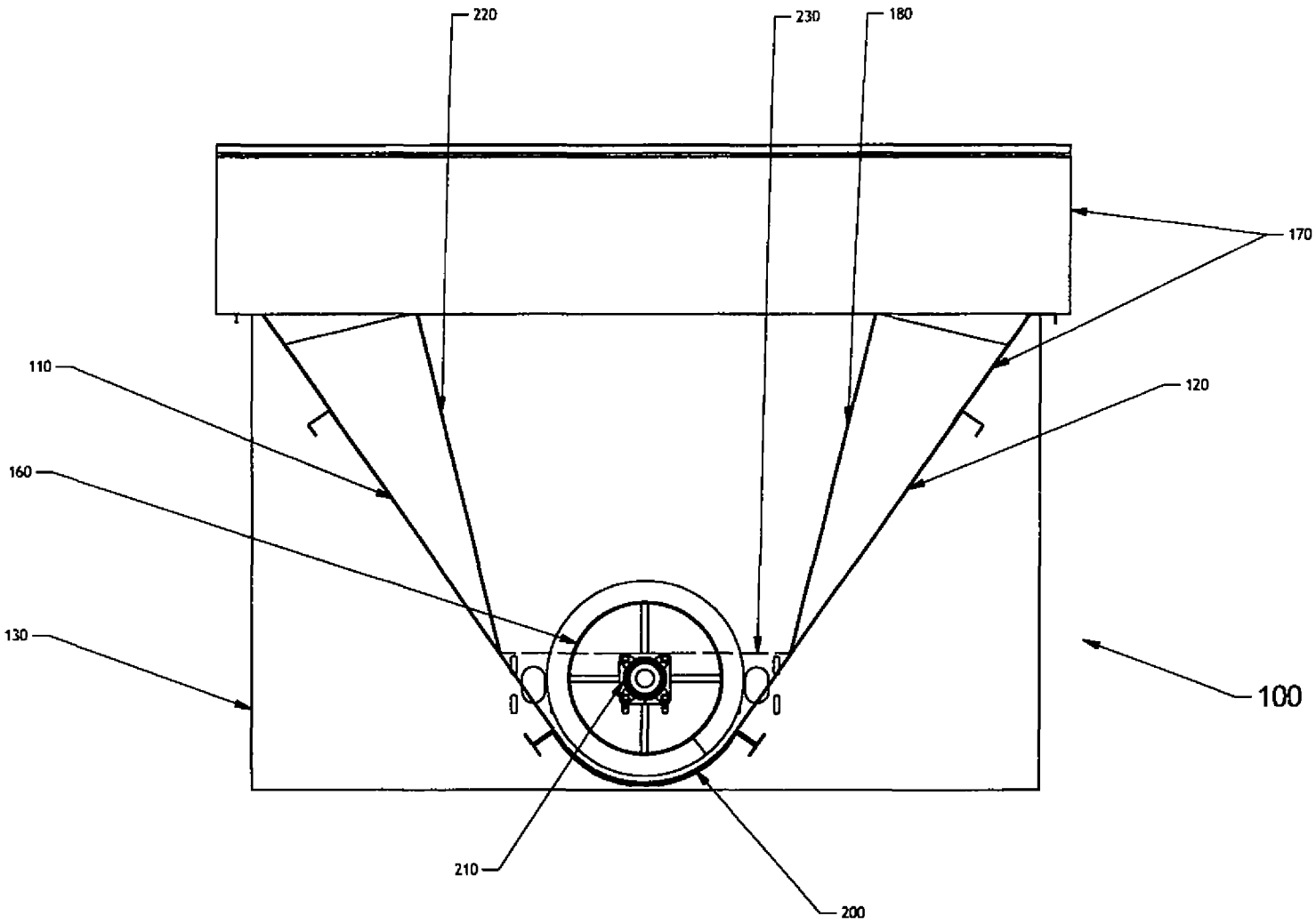
FIG. 4 is a schematic showing a front view of one embodiment of an inclinable mixer for mixing bulk material.

It will be appreciated that although a symmetrical V-shape is shown as a general shape for the trough in FIG. 4, it is within the scope of the invention that an asymmetrical V-shape may be used for the trough. This may be useful, for example, to reduce build-up of bulk material during mixing and guide material back towards the auger 160 for further or more efficient mixing. For example, if a clockwise auger is used bulk material generally builds up on the right hand side wall 120 due to the rotation of the auger 160. This right hand side wall 120 may be positioned at a steeper angle than the left hand side wall 110 to either reduce build up or to guide material back towards the auger 160. A U-shape trough may be also be used and, as outlined above, the mixing chamber may be defined by a tube.

Further, in addition or alternatively, to a steeper side wall various baffles may be used to guide material towards the auger 160 for more efficient mixing. For example, a front baffle 230 positioned above and transverse the auger 160 and parallel the front wall plate 130 may be used. The front baffle 230 may be angled inwards towards the trough as it extends upwards thereby guiding material downwards and into the trough and the auger 160. The front baffle 230 may extend at its bottom edge from the front wall plate 130.

A front side baffle may optionally be used on the front left and/or front right sides to guide material from substantially the front left and/or right corners into the auger 160 for mixing. A front left baffle 220 and a front right baffle 180 are shown in FIGS. 1-4. Although shown as being substantially symmetrical in the Figures, the front baffles may each be independently shaped and situated to reduce build-up of material during mixing and to guide material into the auger 160 or at least away from the front corners to increase efficiency of the mixing. The front left and right baffles 220 and 180 may be independently shaped and situated to take into account asymmetrical build and behaviour of the bulk material being mixed based on, for example, the direction of rotation of the auger 160.

The auger 160 may be for example, a standard auger or a ribbon auger as shown in the Figures. Additionally, a multiple flighted auger, for example a double ribbon auger or multiple ribbon auger may be used such that, for example, a ribbon auger with an 8 foot pitch would have spacing between the flighting of 4 feet if a double ribbon auger were used. A ribbon auger has an additional benefit of allowing for the mixing material to pass through the spaces between the ribbon and auger post which can serve to further mix the material and can also reduce compacting of the material as it mixes. In addition, a front section of the auger may have a higher density of flighting than the back section of the auger. Further, a front face of the ribbon may be covered with a plastic or polymer moulding to further enhance longevity and/or reduce friction during rotation of the auger.

Figure 5:
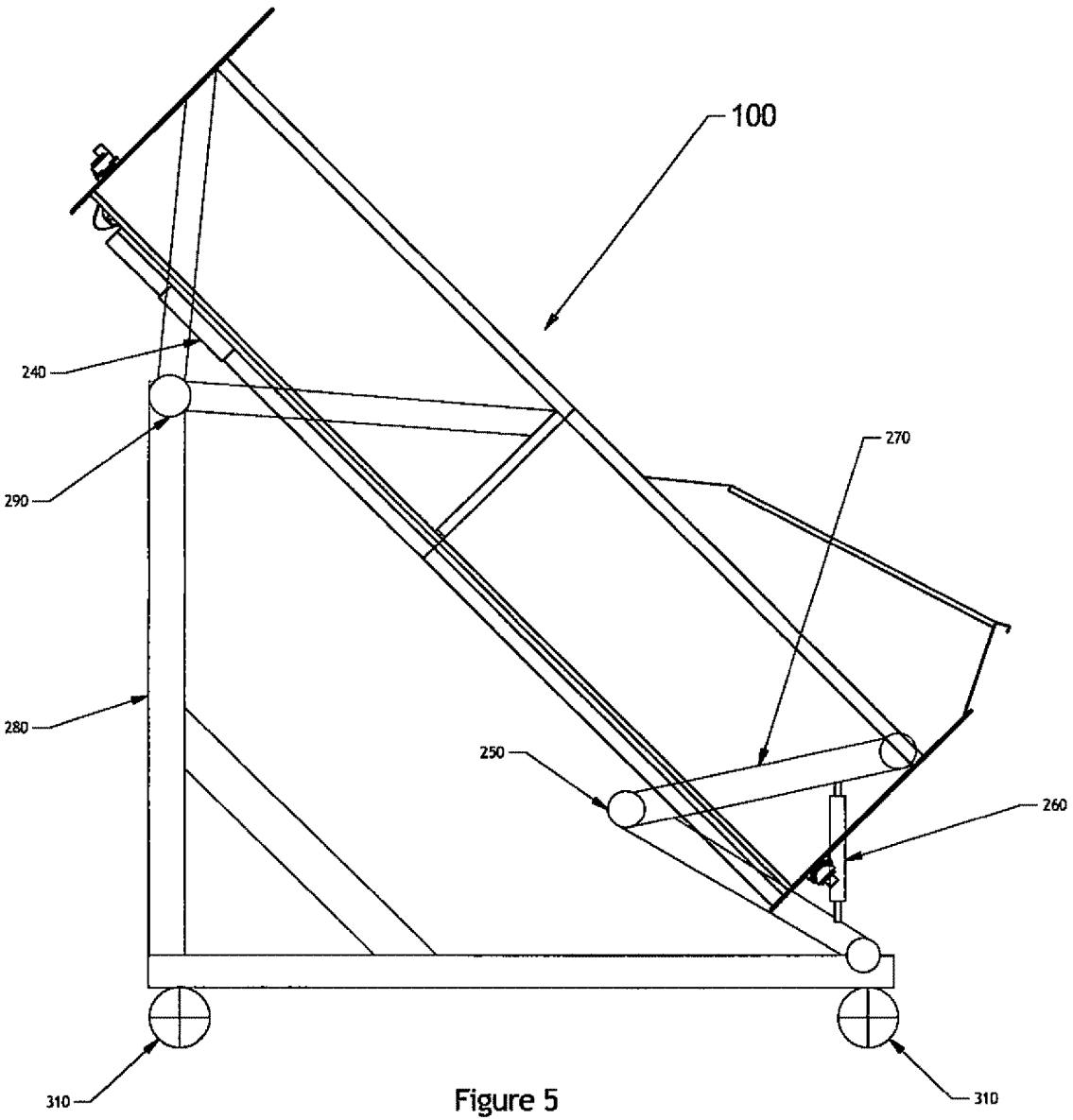
FIG. 5 is a schematic showing a side view of one embodiment of an inclinable mixer for mixing bulk material in an inclined mixing position.

During operation of the mixer 100, bulk material to be mixed is added into the top of the mixing chamber. The mixer 100 may be loaded in either a substantially level or horizontal position such as that shown in FIG. 6 or in an inclined position such as that shown in FIG. 5. Typically, loading is carried out in the inclined position as shown in FIG. 5. The auger 160 may be operational or static during loading and then engaged once loaded. In an inclined position the bulk material being mixed tends to ride upwards along the auger 160 and gradually fall backwards toward the lower front side of the mixing chamber thereby causing further mixing and tumbling action. The mixer 100 may be inclined as little as 20 degrees or at or more than 45 degrees. The lower the degree of incline results in less backward tumbling of the mix and also causes the mix the ride further up the auger 160 and toward the back end and the discharge opening 190. If no trough door 240 is used or if the trough door 240 is in an open position then material can accidentally be lost out the discharge opening. Moving the mixer 100 to a greater inclined position will allow for increased backward tumbling action and also allow for a greater amount of material to be mixed without building up material toward the back of the mixing chamber and up the auger 160 and proximate the discharge opening 190.

In testing an incline of 45-47 degrees showed positive results of excellent variance, meaning very little variance following mixing while also showing reduced compacting of the mix relative standard horizontal mixers. It was also observed that the inclined mixer required reduced power consumption relative to various horizontal mixers known in the industry. This is likely because the mix is compacted less and can be considered less dense and more airy and therefore requires less power consumption.

Figure 6:
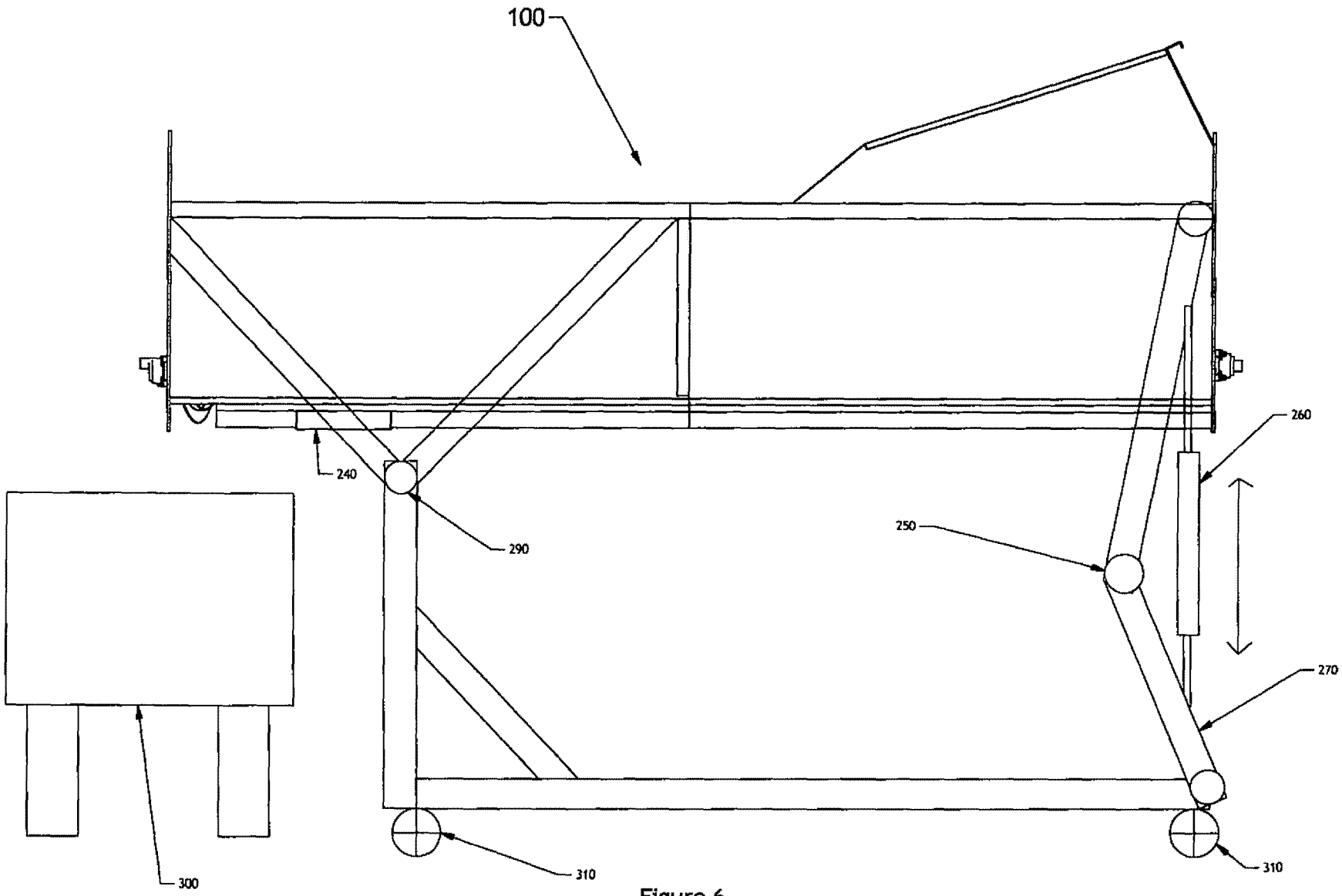
FIG. 6 is a schematic showing a side view of one embodiment of an inclinable mixer for mixing bulk material in a raised level unloading position.

Unloading of the mixing chamber may be done by any number of suitable methods. The auger speed may be increased thereby pushing the mix upwards up the auger 160 and out the discharge opening. The mixer 100 may be moved to an incline closer to or substantially to a level position as shown in FIG. 6. Once in a level position the mix will be pushed upwards along the auger 160 towards the discharge opening 190. The optional trough door 240 may be placed in the opened position and mix with output from the mixing chamber. In one embodiment, the mixer 100 may be on legs that elevate the mixer 100 to a suitable height to allow a delivery vehicle 300 to pass under the mixer 100 and the discharge opening 190 for unloading of the mix into the delivery vehicle 300.

FIGS. 5 and 6 show one embodiment of a mixer 100 that mixes in an inclined position as shown in FIG. 5 and elevates the front end to a substantial level and elevated position for unloading as shown in FIG. 6. A set of front legs 270 are used to raise and lower the front end from between an inclined mixing position and an elevated level unloading position. The front legs 270 are shown as being scissor legs operated using a hydraulic cylinder 260. It will be appreciated that any suitable leg setup may be used for raising and lowering the front end including for example a telescoping leg or legs. The scissor legs shown include a hinge 250 as would be expected.

The back legs 280 can have a fixed length for maintaining the back end of the mixer 100 at a generally fixed height while the incline may be controlled by the front legs 270. It will be appreciated of course that either or both sets of legs may be used to control the angle of the mixing chamber. A hinge 290 is shown for allowing pivot of the mixing chamber on the back legs 280 as the degree of incline of the mixer 100 changes.

Optional scales 310 may be used for determining the weight of the mixer and the change in weight as mix is added and unloaded. The scales 310 may be situated in any suitable location for allowing measuring of the load and change in load to take place. Ideally the scale reading would be either visible to or relayed to the user during unloading to allow a delivery vehicle operator to control unloading without having to exit the delivery vehicle 300. A camera (not shown) may be used to aid positioning of the delivery vehicle 300 beneath the discharge opening 190.

It will be appreciated that any suitable driving device fa driver) may be used for operating the auger 160. This includes for example a direct mechanical drive power by a gas, diesel or electric motor, a power pack, a hydraulic drive system, etc. In one embodiment, a hydraulic drive system may be used to drive the auger 160 and may also be used to operate the hydraulics of the legs to control the inclination of the mixer 100. In this way, a single hydraulic system powered by a single power source may be used to control both the auger 160 and the inclination of the mixer 100. A hydrostat may be used to operate such a system.

It will be appreciated that any suitable device may be used to alter or control the incline of the mixer 100 and may be used in addition to or in place of the legs as shown in FIGS. 5 and 6. For example, a simple chain attached to a crane or lift may be used to raise the back or front end of the mixer, or similar or equivalent such devices are within the scope of the invention.

Figure 7:
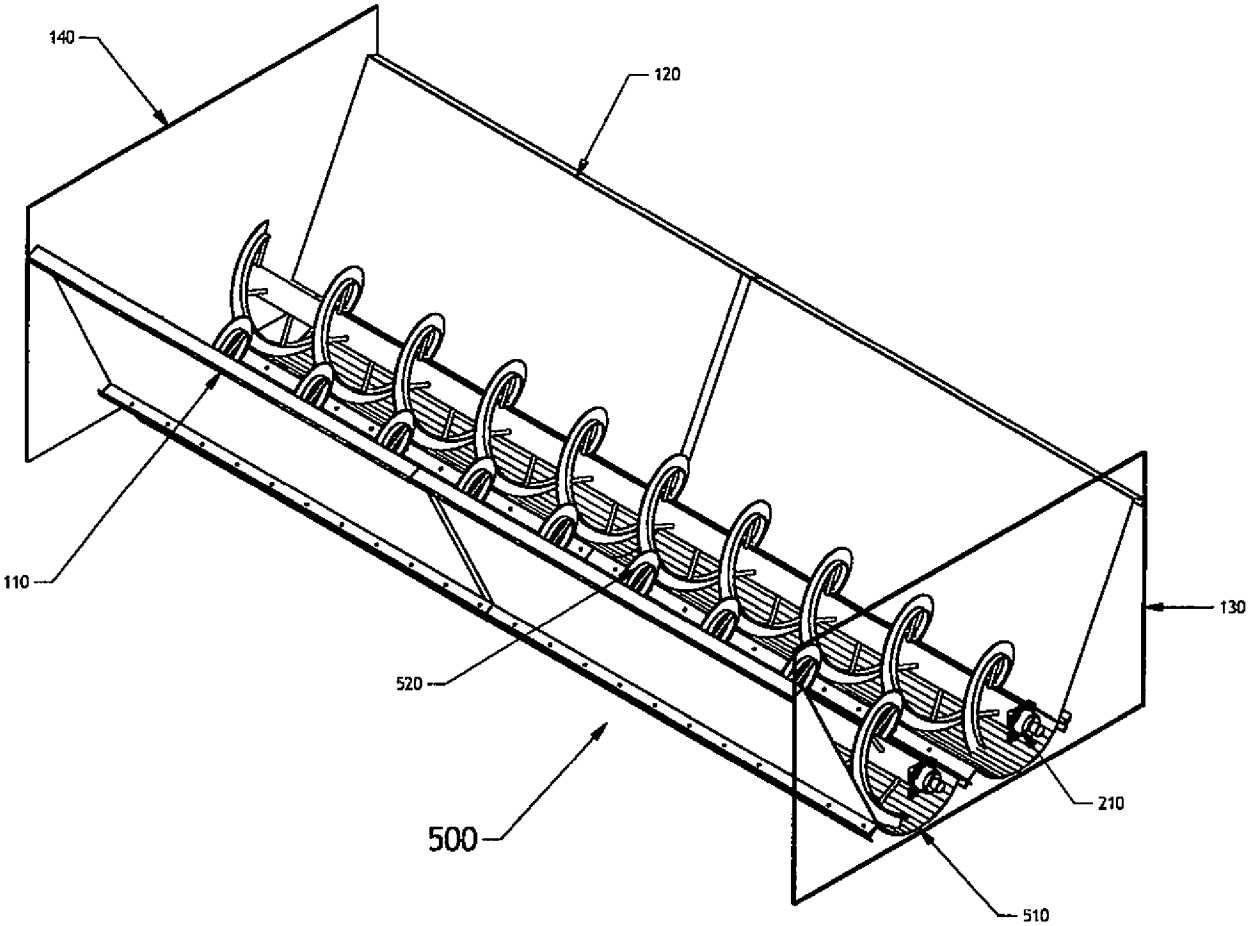
FIG. 7 is a schematic showing an isometric view of one embodiment of a dual auger inclinable mixer for mixing bulk material.
Figure 8:
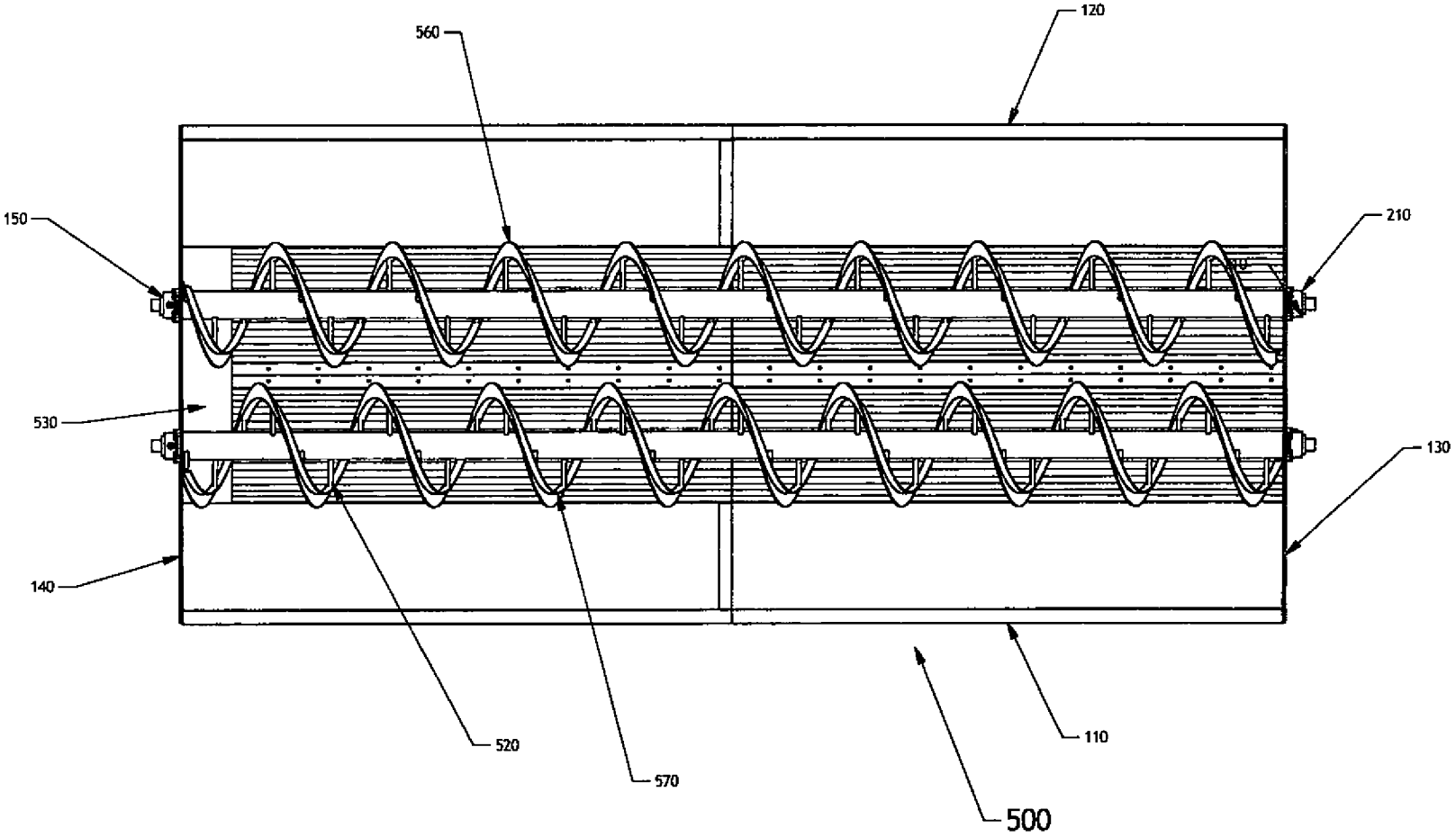
FIG. 8 is a schematic showing a top view of one embodiment of a dual auger inclinable mixer for mixing bulk material.
Figure 9:
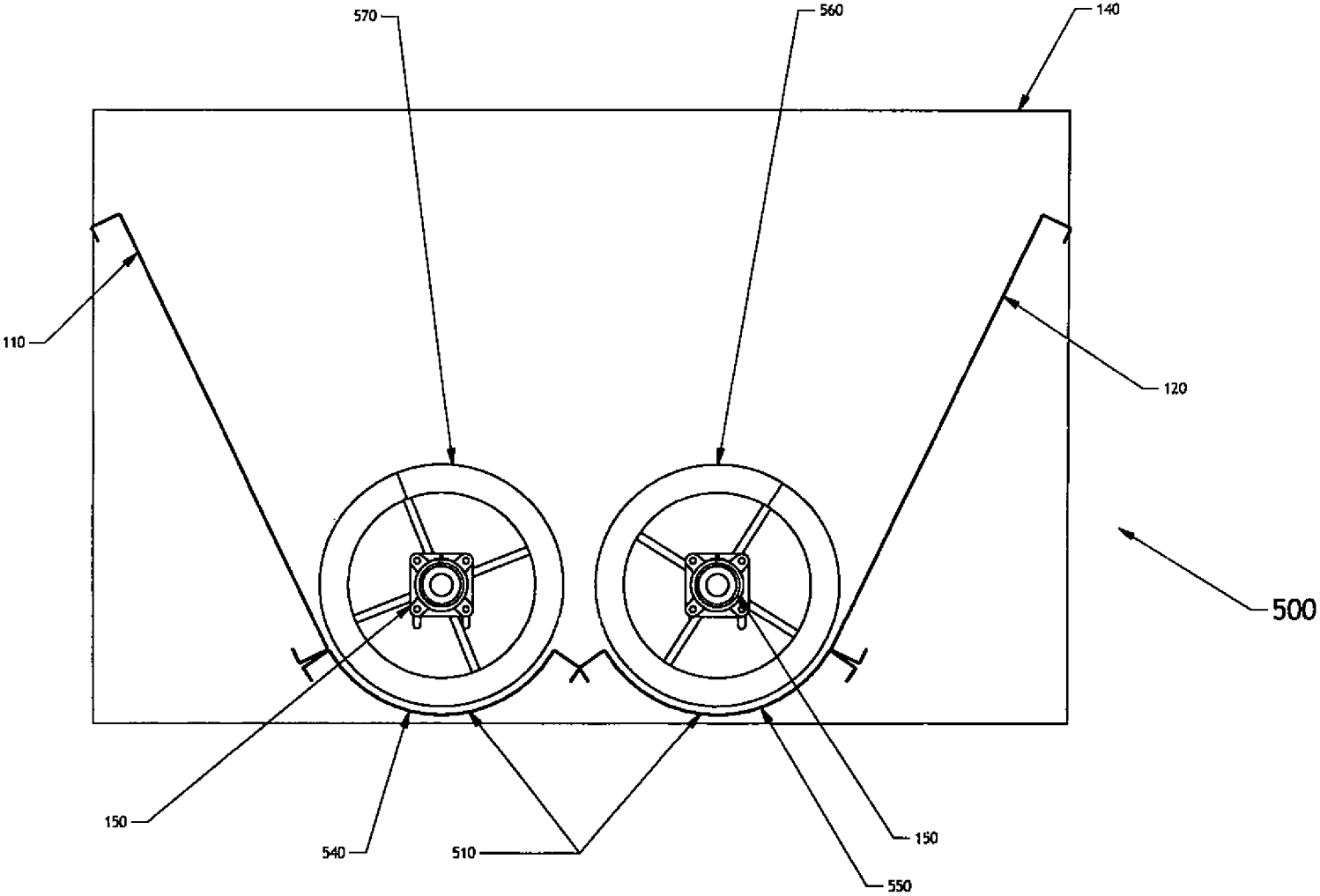
FIG. 9 is a schematic showing a front view of one embodiment of a dual auger inclinable mixer for mixing bulk material.

Further embodiments of an inclinable mixer are shown with reference to FIGS. 7-9. The inclinable mixer 500 is shown without any baffles or trough extensions for ease of understanding but these may be included to increase mixing efficiency and quality and also to reduce spillage as outlined above.

The mixer 500 is a dual auger mixer in that parallel dual augers 520 are positioned longitudinally in the mixing chamber. Further, to accommodate the dual augers 520, the mixing chamber may have a dual trough configuration as shown at 510. Each trough of the dual trough accommodating each auger of the dual auger 520 setup. In one embodiment, each auger of the dual augers 520 may be adapted to rotate in opposite directions. For example, the augers may be adapted to rotate to cause material to be guided inwards to the center of the dual trough, i.e., the right auger 560 may be rotate inwards in a counter clockwise direction while the left auger 570 rotates inwards in a clockwise direction. Such operation of the dual augers 520 should reduce build up and compacting of the mix against the side walls 120 and 110.

Again, the augers of the dual auger 520 may be for example, standard augers or a ribbon augers as shown in the Figures. Additionally a double auger or double ribbon auger may be used such that, for example, a ribbon auger with an 8 foot pitch would have spacing between the flighting of 4 feet if a double ribbon auger were used. As outlined above ribbon auger has an additional benefit of allowing for the mixing material to pass through the spaces between the ribbon and auger post which can further mix the material and can also reduce compacting of the material as it mixes.

As shown in FIGS. 8-9 the dual trough 510 is generally W-shaped with interior walls 540 and 550 defining the inside portion of each of the two troughs. These interior walls 540 and 550 may be shorter than the exterior walls 110 and 120 and may be of a sufficient shortness in height to allow mixing material to pass over the interior walls for greater and further mixing action. The interior walls 540 and 550 may be joined directed together along their top edges or, as shown, may be connected using a further intermediary plate.

Again, and as outlined above with reference to FIGS. 1-5, the bottom of each trough may be rounded to substantially match the exterior profile of the auger (as shown) or may simply be defined by the connection point of the lower edges between the exterior and interior walls.

A dual trough discharge opening 530 is used to output mix from the dual trough mixing chamber. Unloading and loading may be carried out as described above with reference to the single trough mixer and a trough door may be used also as described above.

It will be appreciated that the dual auger mixer may be operated, inclined, loaded and unloaded, and powered in a similar manner as that outlined above with respect to the single auger mixer described with reference to FIGS. 1-6. Further, it is also contemplated that a mixer may include any number of suitable augers and may include more than one or two augers as outlined herein. Such a mixer may have a dedicated trough or tube for each auger with, optionally, a dedicated input and/or output opening for each auger.

It will be appreciated that a dual tube setup may also be used to accommodate a dual auger mixer. The dual tube having one or more openings for input of material and one or more openings for output of mixed material.

It will be appreciated that the mixers outlined herein may be used to mix any suitable bulk material loaded therein. The bulk material may include but is not limited to animal feed of various compositions including various additives and fibrous bases, compost, bedding, polymers, fertilizer, etc.

Further structural support may be included in the mixer 100 including truss systems (not shown) spanning the length or part of the length or a portion or all of the perimeter of the mixer. The mixing chamber including for example the trough, end wall plates, trough extensions and/or baffles may be designed to be bolted together to allow for ease of replacement of worn or damaged components. Further the trough may be comprises of a plurality of sections which may be bolted together to allow for ease of replacement of worn or damaged sections. The additional structural support, for example the truss system, may be welded together to increase structural rigidity of the mixer 100 including mixers which are adapted to be bolted together as outlined above.

Mixers, methods of mixing and operations for mixing bulk material have been described herein. It is intended that various modifications, alterations and substitutions may be made to these mixers, methods of mixing and operations for mixing bulk material without departing from the scope and spirit and these modifications, alterations and substitutions are contemplated to be within the invention.

We claim:

1. An inclinable mixer for mixing bulk material, the inclined mixer comprising:

a mixing chamber comprising:

a longitudinal trough defined by a first and second side wall oppositely opposed, the trough having a front end opposite a back end, a discharge opening positional substantially toward the back end of the mixing chamber, and a front wall spanning the front end of the trough, front legs for supporting the front end of the mixing chamber, back legs for supporting the back end of the mixing chamber, an auger situated longitudinally in the trough for mixing bulk material, and a driver configured to rotate the auger when a driving force is applied, wherein the front legs are adapted to raise and lower the front end of the mixer to change the degree of incline of the mixer such that the back end is raised relative to the front end at least during mixing;

wherein the back legs maintain the back end of the mixing chamber at a substantially fixed height while the front end is raised or lowered; and wherein the front legs are scissor legs.

2. The inclinable mixer of claim 1, wherein the back legs are positioned inward from the back end such that the discharge opening is closer to the back end than the back legs allowing the discharge opening to output material mixed therein without interference from the back legs.

3. The inclinable mixer of claim 1, wherein the front legs are hydraulically operated by a hydraulic cylinder.

4. The inclinable mixer of claim 1, further comprising:

a front baffle positioned at the front end of the mixing chamber and transverse and above the auger for guiding bulk material towards the auger, and optionally a front right baffle positioned at the front end of the mixing chamber between the auger and the second side wall for guiding bulk material towards the auger, and/or a front left baffle positioned at the front end of the mixer chamber between the auger and the first side wall for guiding bulk material towards the auger.

5. The inclinable mixer of claim 1, wherein the trough is a V-shaped trough, a U-shaped trough or a tube.

6. The inclinable mixer of claim 1, wherein the first and second side walls of the trough are substantially asymmetrical with one of the two side walls situated at a steeper angle relative the other side wall.

7. The inclinable mixer of claim 1, wherein the mixing chamber is operable for inclination to above 20 degrees during mixing, to above 40 degrees during mixing, or above 45 degrees during mixing.

8. The inclinable mixer of claim 1, wherein the mixing chamber further comprises:

a second longitudinal trough defined by a third and fourth side wall oppositely opposed, the second trough having a front end opposite a back end, a discharge opening positioned substantially toward the back end of the second trough, and a front wall spanning the front end of the second trough, the mixer further comprising a second auger situated longitudinally in the second trough for mixing bulk material, and optionally the first and second augers are adapted to rotate in opposite directions during mixing.

9. The inclinable mixer of claim 8, wherein the second and third side walls are connected directly or indirectly at their top edges and are sufficiently short to allow for bulk material mixing in the chamber to pass over their top edges.

10. The inclinable mixer of claim 1, wherein the driver is hydraulically powered and optionally wherein the front legs are hydraulically powered and the front legs and the driver are operated by the same hydraulic system and optionally by the same hydraulic drive source.

11. The inclinable mixer of claim 1, wherein the discharge opening is positioned in substantially the bottom of the trough toward the back end of the mixing chamber.

12. The inclinable mixer of claim 1, wherein the discharge opening is positioned in the side of the trough toward the back end of the mixing chamber.

13. The inclinable mixer of claim 1, wherein the mixer further comprises a trough door situated over the discharge opening and movable between a closed position wherein the trough door covers the discharge opening and an opened positioned wherein the trough door uncovered the discharge opening and allows output of material from the chamber.

14. The inclinable mixer of claim 1, further comprising one or more additional augers, each associated with one or more additional troughs.

15. The inclinable mixer of claim 1, wherein a front section of the auger has a higher density of flights than a back section of the auger.

16. The inclinable mixer of claim 1, wherein the auger is a ribbon auger or a multiple ribbon auger.

17. The inclinable mixer of claim 16, wherein a front face of the ribbon auger is covered with a plastic/polymer moulding or stainless steel or wear surface.

18. The inclinable mixer of 32, wherein the mixer is a batch mixer.

19. An inclinable mixer for mixing bulk material, the inclinable mixer comprising: a mixing chamber comprising: a longitudinal trough defined by a first and second side wall oppositely opposed, the trough having a front end opposite a back end, a discharge opening positional substantially toward the back end of the mixing chamber, and a front wall spanning the front end of the trough, front legs structured to support the front end of the mixing chamber, the front legs being scissor legs operable by a hydraulic cylinder, an auger situated longitudinally in the trough for mixing bulk material, and a driver configured to rotate the auger when a driving force is applied, wherein the mixing chamber is inclined such that the back end is raised relative to the front end at least during mixing; wherein the first and second side walls of the trough are substantially asymmetrical with one of the two side walls situated at a steeper angle relative the other side wall; wherein at least a portion of the hydraulic cylinder is provided separately from the front legs so as to be spaced at least in part from the front legs; and wherein back legs for supporting the back end of the mixing chamber maintain the back end of the mixing chamber at a substantially fixed height while the front end is raised or lowered.

20. The inclinable mixer of claim 19, further comprising: the front legs being adapted to raise and lower the front end of the inclinable mixer to change the degree of incline of the inclinable mixer such that the inclinable mixer is movable between a mixing position wherein the front end is lowered relative the back end to position the inclinable mixer in an inclined orientation and an unloading position wherein the front end and the back end are generally level.

* * * * *